US006398588B1

(12) United States Patent
Bickford

(10) Patent No.: US 6,398,588 B1
(45) Date of Patent: Jun. 4, 2002

(54) METHOD AND APPARATUS TO REDUCE EMI LEAKAGE THROUGH AN ISOLATED CONNECTOR HOUSING USING CAPACITIVE COUPLING

(75) Inventor: Brad Bickford, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/474,838

(22) Filed: Dec. 30, 1999

(51) Int. Cl.[7] ..... H01R 13/66

(52) U.S. Cl. ..... 439/608; 439/620; 333/12; 333/181; 333/24 C

(58) Field of Search ..... 333/12, 181, 167, 333/24 C; 439/608, 607, 620

(56) References Cited

U.S. PATENT DOCUMENTS 5,192,230 A * 3/1993 Gabany et al. ..... 439/620
5,397,252 A * 3/1995 Wang ..... 439/620
5,413,504 A * 5/1995 Kloecker et al. ..... 439/620
5,611,711 A * 3/1997 Okada et al. ..... 439/608
6,033,263 A * 3/2000 Weidler et al. ..... 439/620
6,109,972 A * 8/2000 Leinonen et al. ..... 439/620

* cited by examiner

*Primary Examiner*—Robert Pascal
*Assistant Examiner*—Stephen E. Jones
(74) *Attorney, Agent, or Firm*—Blakely, Sokoloff, Taylor & Zafman LLP

(57) ABSTRACT

A capacitive coupling includes a capacitive material and a conductor coupled to the capacitive material. The conductor and the capacitive material have a form factor to fixedly attach to either a connector housing or a chassis of an electronic device. The form factor of the conductor and the capacitive material is also to removably couple the connector housing and the chassis of the electronic device such that at least one signal frequency is passed between the connector housing and the chassis of the electronic device and a direct current is isolated between the connector housing and the chassis of the electronic device.

14 Claims, 7 Drawing Sheets

METHOD AND APPARATUS TO REDUCE EMI LEAKAGE THROUGH AN ISOLATED CONNECTOR HOUSING USING CAPACITIVE COUPLING

FIELD OF THE INVENTION

The present invention pertains to the field of electronic device connectors. More particularly, the present invention relates to reducing electromagnetic interference (EMI) leakage through a connector housing that is required to be electrically isolated from a chassis of a device to which the connector housing is coupled.

BACKGROUND INFORMATION

Connectors are used to couple together a wide variety of electronic devices including computers, peripheral devices, audio/video components, telephones, network terminals, etc. For instance, a personal computer may have several different connectors, both male and female, for hooking up components such as a monitor, a key board, and a mouse, and may include additional connectors for networking such as an Ethernet card connector.

For various reasons, connector housings are often "isolated" from the ground (usually the chassis) of the device to which a connector housing is coupled. For instance, in the event of a "ground surge," such as a lightening strike on a telephone line leading to a computer, every component in the computer coupled to the chassis may experience a large and potentially damaging current. By isolating the connector housing from the chassis, a ground surge is less likely to be propagated to another device or into a network to which the connector leads.

FIGS. 1A and 1B illustrate one example of an isolated connector housing 120 in an electronic device 100. Chassis 110 contains a printed circuit board (PCB) 140. PCB 140 includes an integrated circuit (IC) 150, which is coupled to connector housing 120 through a bus 155. A signal path 150 couples bus 155 on PCB 140 through connector housing 120 to any of a number of peripheral devices, networks, etc. (not shown).

Connector housing 120 is indirectly coupled to chassis 110 in that connector housing 120 is mount to PCB 140 using mounting screws 160 and PCB 140 is mounted within chassis 110. Furthermore, connector aperture 130 in chassis 110 is larger than the dimensions of connector housing 120 so that connector housing 120 does not make direct contact with chassis 110. In which case, connector housing 120 is isolated from chassis 110.

Although isolating a connector from ground has certain advantages, it also has some disadvantages. For instance, if electronic device 100 generates electromagnetic interference (EMI), which virtually all electronic devices do, the EMI may leak into signal path 150 through connector housing 120. Market pressures are constantly moving toward faster, more reliable data transfer, and EMI leakage is a limiting factor on performance.

SUMMARY OF THE INVENTION

A capacitive coupling includes a capacitive material and a conductor coupled to the capacitive material. The conductor and the capacitive material have a form factor to fixedly attach to either a connector housing or a chassis of an electronic device. The form factor of the conductor and the capacitive material is also to removably couple the connector housing and the chassis of the electronic device such that at least one signal frequency is passed between the connector housing and the chassis of the electronic device and a direct current is isolated between the connector housing and the chassis of the electronic device.

BRIEF DESCRIPTION OF THE DRAWINGS

Examples of the present invention are illustrated in the accompanying drawings. The accompanying drawings, however, do not limit the scope of the present invention. Like references in the drawings indicate similar elements.

DETAILED DESCRIPTION

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternate embodiments. In other instances, well known methods, procedures, components, and circuits have not been described in detail.

Parts of the description will be presented using terminology commonly employed by those skilled in the art to convey the substance of their work to others skilled in the art. Also, parts of the description will be presented in terms of operations performed through the execution of programming instructions. As well understood by those skilled in the art, these operations often take the form of electrical, magnetic, or optical signals capable of being stored, transferred, combined, and otherwise manipulated through, for instance, electrical components.

Various operations will be described as multiple discrete steps performed in turn in a manner that is helpful in understanding the present invention. However, the order of description should not be construed as to imply that these operations are necessarily performed in the order they are presented, or even order dependent. Lastly, repeated usage of the phrase "in one embodiment" does not necessarily refer to the same embodiment, although it may.

The present invention reduces electromagnetic interference (EMI) leakage while maintaining direct current (DC) isolation of a connector by capacitively coupling the connector to the chassis of an electronic device to which the connector is coupled. Various capacitive materials act as short circuits for high frequency signals (such as EMI) and act as open circuits to direct currents (such as ground surges). EMI leakage tends to resonate at particular frequencies based on the operating frequency (and harmonics thereof) of a device generating the EMI. Depending on the frequency harmonics of the EMI, those skilled in the art can select an appropriate capacitive material to short out the EMI while maintaining DC isolation. Any of a number of capacitive materials can be used such as epoxies, nylons, and phenolics.

Figure 1A:
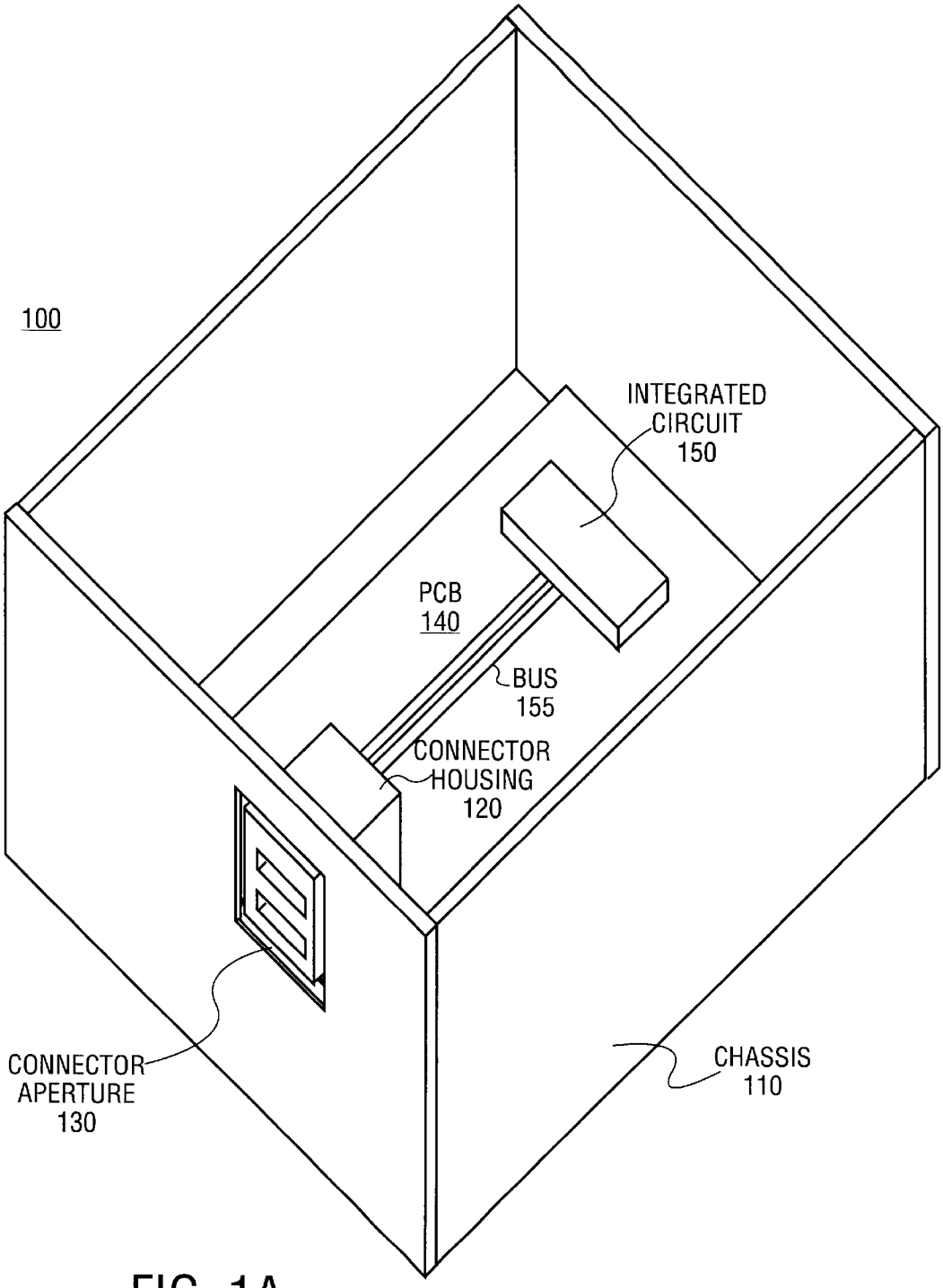
FIG. 1A (PRIOR ART)
FIGS. 1A and 1B illustrate a prior art connector configuration.
Figure 1B:
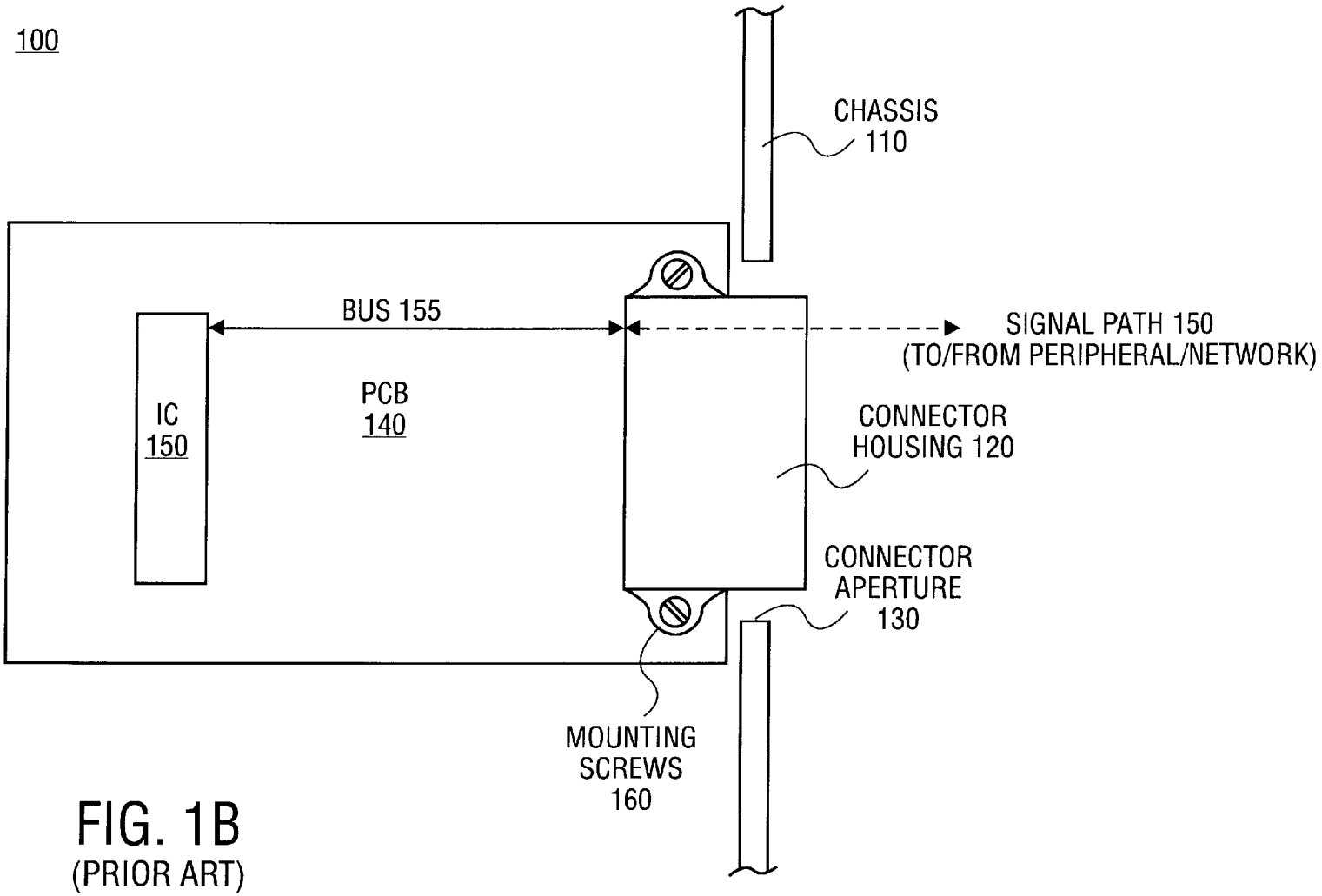
FIG. 1B (PRIOR ART)
Figure 2:
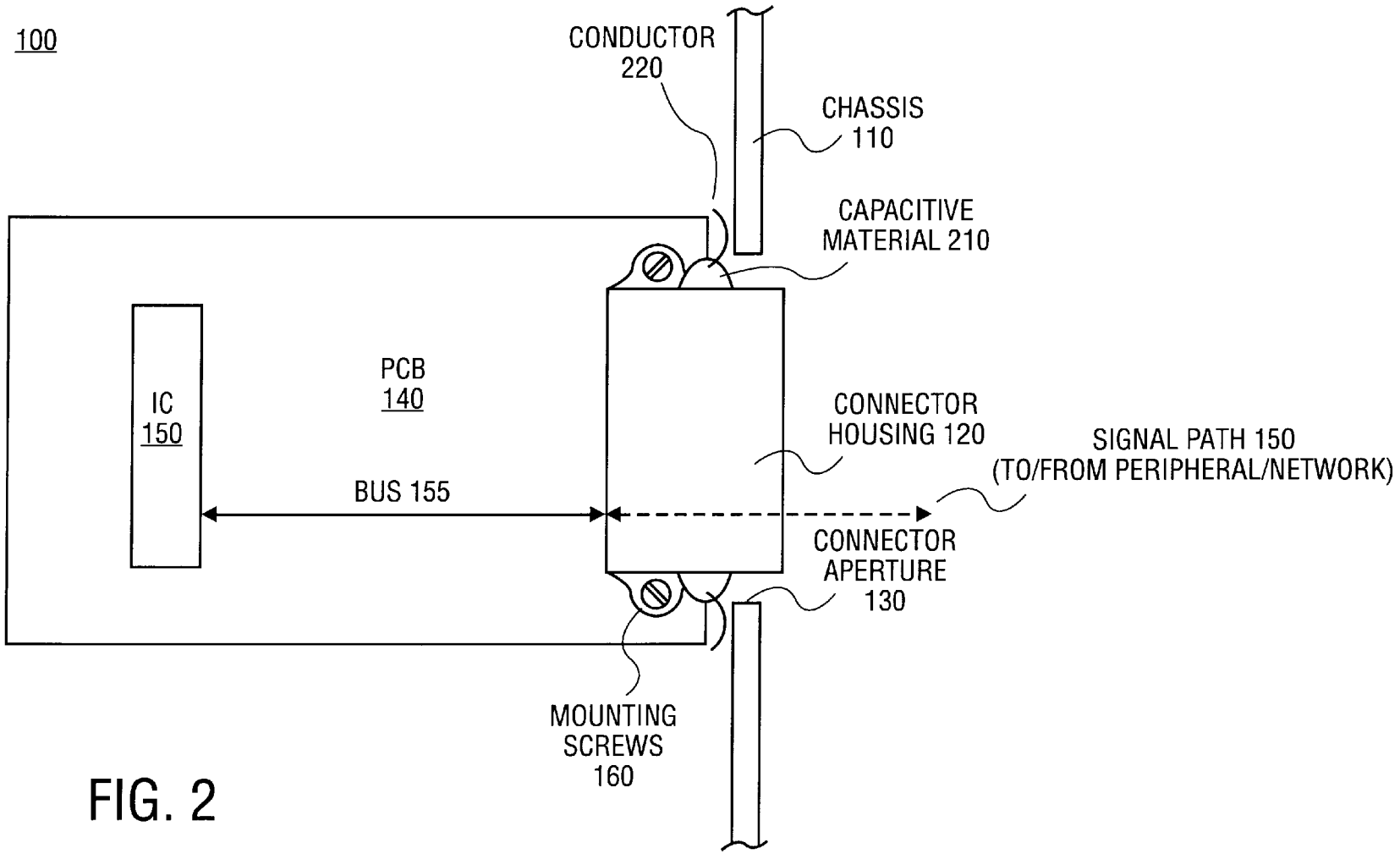
FIG. 2 illustrates one embodiment of the present invention.

FIG. 2 illustrates one embodiment of the present invention used in an electronic device 100 as illustrated in FIG. 1. Electronic device 100 is intended to represent a broad category of electronic devices such as those known in the art, including computer systems, set-top boxes, internet appliances, audio/video components, etc. Electronic device 100 produces EMI. For instance, if electronic device 100 is a personal computer, the EMI is likely to resonate at certain frequency harmonics, such as 66 Mhz or 100 Mhz, corresponding to the operating speed of the chip set used inside the computer.

In the embodiment of FIG. 2, capacitive material 210 is applied to connector housing 120. Conductor 220 couples capacitive material 210 to chassis 110 of the electronic device. Together, conductor 220 and capacitive material 210 comprise a capacitive coupling between connector housing 120 and chassis 110. Capacitive material 210 is selected so that EMI generated by, for instance, IC 150 and bus 155 are shorted to chassis 110 through the capacitive coupling while connector housing 120 remains largely isolated to direct current.

In the illustrated embodiment, conductor 220 is designed to be compressible, rather like a leaf spring. As connector housing 120 is installed on PCB 140 in chassis 110, or as PCB 140 is installed in chassis 110 with connector housing 120 already in place, conductor 220 presses against chassis 110 and compresses. Using a compressible design better ensures contact between chassis 110 and conductor 220, and allows for some variation in the dimensions of PCB 140, chassis 110, and connector housing 120. In alternate embodiments, any number of compressible designs can be used, such as a conductor having a "Y" shape or a conductor having a section folded back over on itself.

Those skilled in the art will recognize that chassis 110 may include several separate components. For instance, chassis 110 may include a removable input/output (I/O) shield (not shown) that is removed to install or replace PCB 140. An I/O shield is often found on the back of a personal computer, and often includes apertures, such as connector aperture 130, for various I/O ports. In which case, an I/O shield of chassis 110 may be pressed against conductor 220 to establish the capacitive coupling as the I/O shield is installed.

Capacitive couplings may be added to the connector housing in any number of ways and in any number of positions to better ensure a good connection. FIG. 2 illustrates two capacitive couplings, one on either side of connector housing 120. Some additional embodiments of the present invention are illustrated in FIGS. 3 through 6.

Figure 3B:
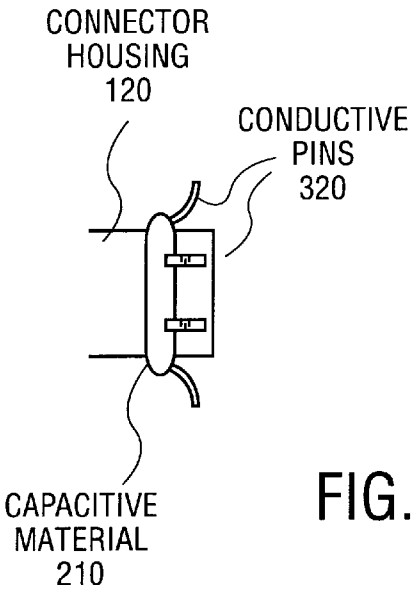
FIGS. 3A and 3B illustrate one embodiment of the present invention.
Figure 3A:
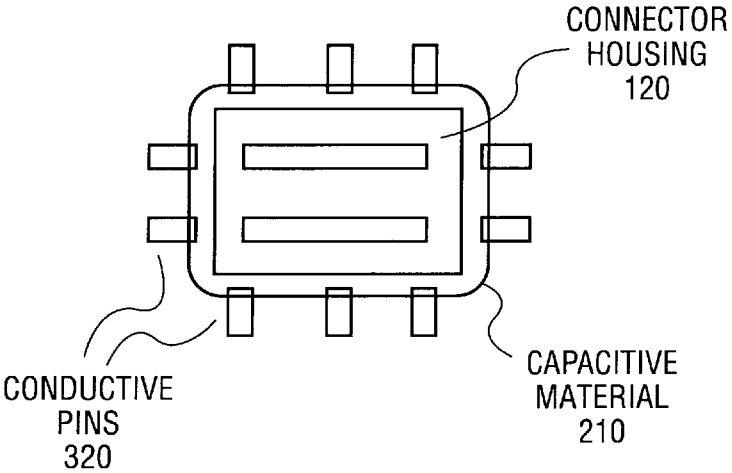

FIG. 3A illustrates one embodiment of connector housing 120 as seen from a front view. Capacitive material 210 is applied all around connector housing 120. Conductive pins 320 extend from capacitive material 210 at several different locations to increase the likelihood of contact with the chassis. FIG. 3B illustrates the same embodiment as seen from the side. Capacitive material 210 attaches to connector housing 120 much like a gasket held in place by an adhesive. Conductive pins 320 are embedded in capacitive material 210 and extend toward the front of connector housing 120 so as to compress against the chassis when installed. In alternate embodiments, any of a number of techniques can be used to fixedly attach the capacitive material to the connector housing and to fixedly attach the conductor(s) to the capacitive material.

Figure 4A:
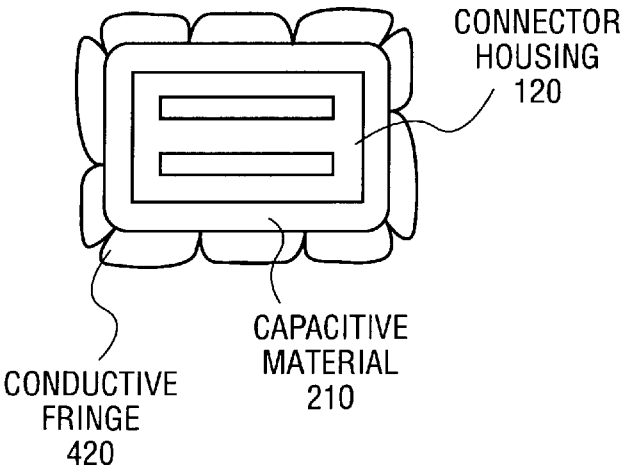
FIGS. 4A and 4B illustrate one embodiment of the present invention.
Figure 4B:
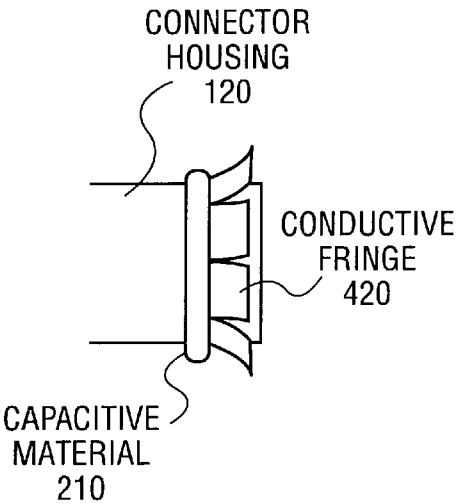

FIGS. 4A and 4B illustrate a similar embodiment as shown in FIGS. 3A and 3B with the exception of conductive fringe 420. Rather than using a number of pins, conductive fringe 420 spreads out like a skirt when compressed against the chassis.

Figure 5:
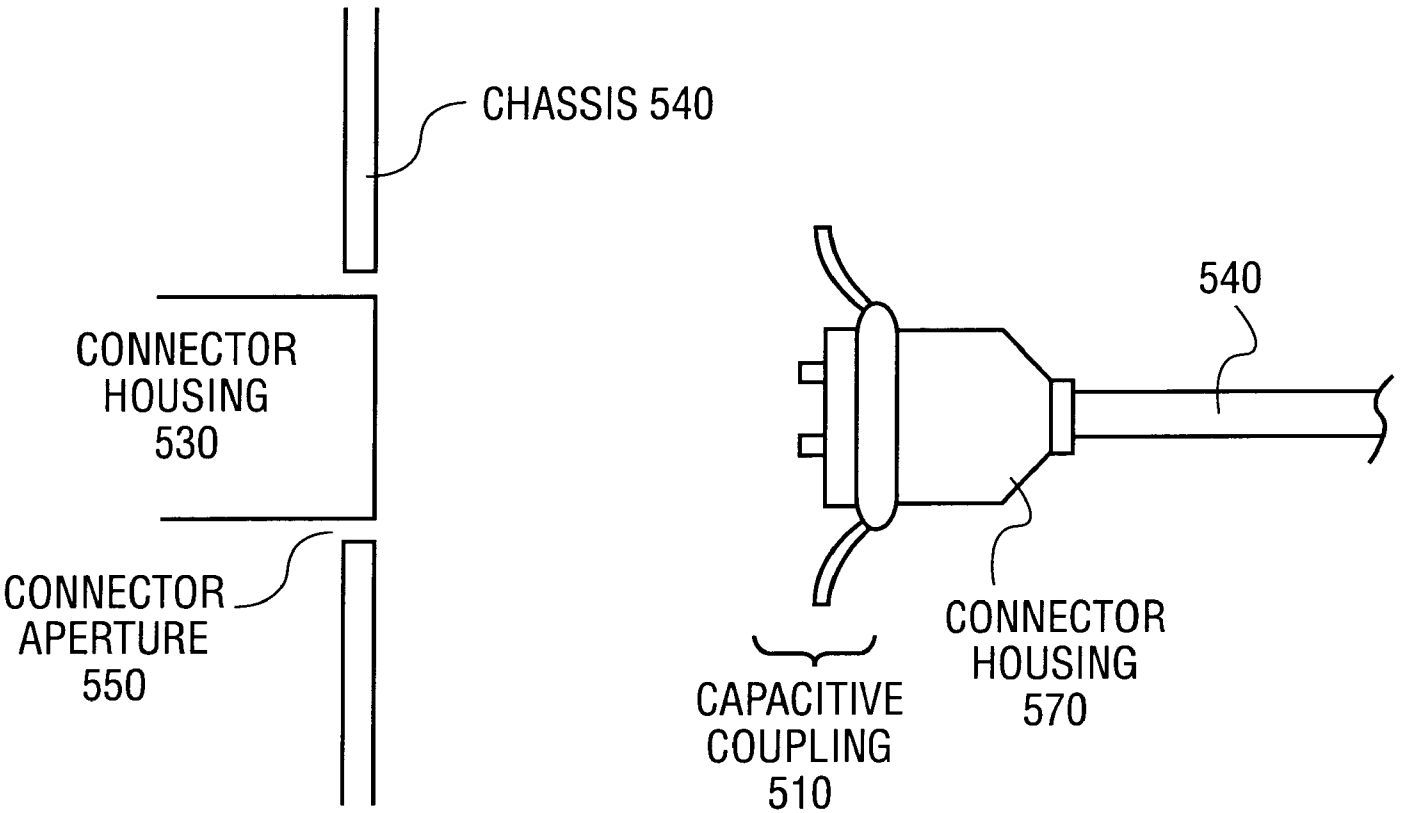
FIG. 5 illustrates one embodiment of the present invention.

FIG. 5 illustrates one embodiment of the present invention used with a cable-mounted connector housing 520 on the end of a cable 540. When cable-mounted connector housing 520 is coupled to PCB-mounted connector housing 530 inside chassis 540, capacitive coupling 510 shorts high frequency signals, such as EMI, to chassis 540. Capacitive coupling 510 also maintains the isolation of connectors 520 and 530 across connector aperture 550 for direct current. Any number of capacitive coupling configurations, such as those described above for a PCB-mounted connector, can similarly be used on a cable mounted connector such as connector housing 520. In another embodiment, capacitive couplings can be used on both PCB-mounted and cable-mounted connectors simultaneously.

Figure 6B:
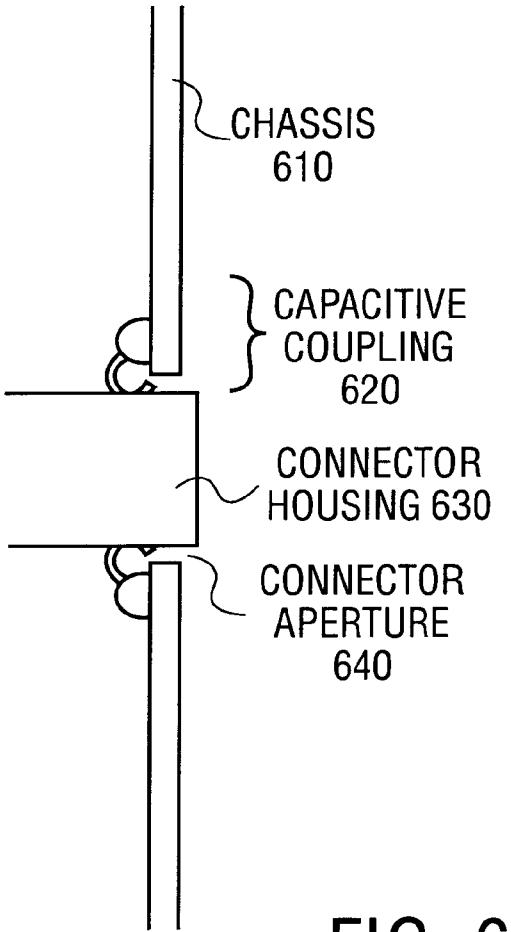
FIGS. 6A and 6B illustrate one embodiment of the present invention.
Figure 6A:
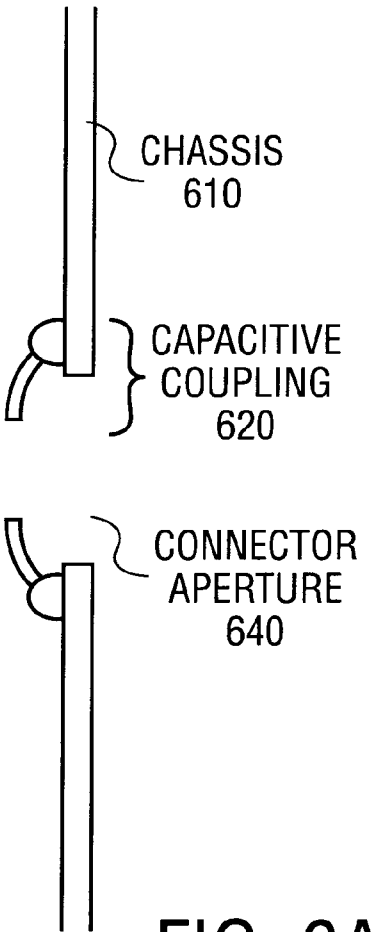

FIGS. 6A and 6B illustrate yet another embodiment of the inventive capacitive coupling. In FIGS. 6A and 6B, capacitive coupling 620 is affixed to chassis 610.

When connector housing 630 (either a PCB-mounted or cable-mounted connector) is installed at connector aperture 640, capacitive coupling 620 shorts high frequency signals to chassis 610 and maintains isolation for direct current. As discussed above, those skilled in the art will recognize that chassis 610 may be just one part of a chassis for an electronic device, such as an I/O shield on the back of a personal computer. Also, any number of capacitive coupling configurations, such as those described above for a connector-mounted couplings, can similarly be used on a chassis-mounted coupling such as capacitive coupling 620.

Thus, a method and apparatus to reduce electromagnetic interference (EMI) leakage while maintaining direct current (DC) isolation of a connector by capacitively coupling the connector to the chassis of an electronic device is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. A capacitive coupling comprising:

a capacitive material; and a conductor coupled to the capacitive material, said conductor and said capacitive material having a form factor to fixedly attach to a connector housing, and having a compressible design to compressibly mate with a chassis of an electronic device and to removably couple the connector housing and the chassis of the electronic device such that at least one signal frequency is passed between the connector housing and the chassis of the electronic device and a direct current is isolated between the connector housing and the chassis of the electronic device.

2. The apparatus of claim 1 wherein the at least one signal frequency comprises a frequency of electromagnetic interference (EMI) produced by the electronic device.

3. The apparatus of claim 1 wherein the at least one signal frequency comprises an operating frequency of the electronic device and harmonic frequencies thereof.

4. The apparatus of claim 1 wherein the electronic device comprises one of a personal computer, an internet appliance, and a palm-top device.

5. The apparatus of claim 1 wherein the connector housing is one of a cable-mounted connector housing and a printed circuit board (PCB) mounted connector housing.

6. The apparatus of claim 1 wherein the connector housing is to couple the electronic device to one of a peripheral device and a network.

7. The apparatus of claim 1 wherein the capacitive material comprises at least one of an epoxy material, a nylon material, and a phenolic material.

8. The apparatus of claim 1 wherein the capacitive material comprises a dielectric material that approximates a short circuit at the at least one signal frequency.

9. The apparatus of claim 1 wherein the capacitive material is to fixedly attach to the connector housing, and the conductor is coupled to the capacitive material and isolated from the connector housing by the capacitive material.

10. The apparatus of claim 1 wherein the conductor comprises one of a plurality of pins and a conductive fringe.

11. The apparatus of claim 1 wherein the capacitive material surrounds the connector housing and the conductor comprises a plurality of elements extending from the capacitive material.

12. A method comprising:

fixedly attaching a capacitive material to a connector housing, said capacitive material having a conductor coupled there to;

compressibly mating the conductor and a chassis of an electronic device, said conductor having a compressible design to compressibly mate with the chassis of the electronic device; and removably coupling the connector housing and the chassis of the electronic device through the capacitive material and the conductor such that at least one signal frequency is passed between the connector housing and the chassis of the electronic device and a direct current is isolated between the connector housing and the chassis of the electronic device.

13. The method of claim 12 wherein the conductor comprises a compressible design, wherein fixedly attaching the capacitive material comprises applying the capacitive material to the connector housing, and wherein removably coupling the connector housing and the chassis of the electronic device comprises compressing the conductor against the chassis of the electronic device.

14. An apparatus comprising:

capacitive means; and means for conducting coupled to the capacitive means, said means for conducting and said capacitive means having a form factor for fixedly attaching to a connector housing, and having a compressible design to compressibly mate with a chassis of an electronic device and for removably coupling the connector housing to the chassis of the electronic device such that at least one signal frequency is passed between the connector housing and the chassis of the electronic device and a direct current is isolated between the connector housing and the chassis of the electronic device.

* * * * *